US006311790B1

(12) United States Patent
Beckwith et al.

(10) Patent No.: US 6,311,790 B1
(45) Date of Patent: Nov. 6, 2001

(54) REMOVABLE BORING HEAD WITH TAPERED SHANK CONNECTOR

(75) Inventors: Jerry W. Beckwith; Floyd R. Gunsaulis, both of Perry, OK (US)

(73) Assignee: The Charles Machines Works, Inc., Perry, OK (US)

( * ) Notice: Subject to any disclaimer, the term of this patent is extended or adjusted under 35 U.S.C. 154(b) by 0 days.

(21) Appl. No.: 09/575,978

(22) Filed: May 23, 2000

(51) Int. Cl.[7] ..... E21B 7/00; E21B 10/00

(52) U.S. Cl. ..... 175/62; 175/320

(58) Field of Search ..... 175/61, 62, 19, 175/73–76, 320, 397, 398, 376, 400; 403/359.5, 359.6; 166/65.1, 242.6

(56) References Cited

U.S. PATENT DOCUMENTS

| | | | | |
|---|---|---|---|---|
| 2,255,721 | | 9/1941 | Mattingly et al. | 255/1 |
| 3,746,106 | | 7/1973 | McCullough et al. | 175/45 |
| 4,586,845 | | 5/1986 | Morris | 403/354 |
| 4,592,432 | | 6/1986 | Williams et al. | 175/26 |
| 4,658,915 | | 4/1987 | Goris et al. | 175/57 |
| 4,728,124 | | 3/1988 | Righi et al. | 285/2 |
| 4,787,463 | | 11/1988 | Geller et al. | 175/45 |
| 4,854,398 | | 8/1989 | Holloway | 175/45 |
| 4,907,658 | | 3/1990 | Stangl et al. | 175/19 |
| 4,947,944 | | 8/1990 | Coltman et al. | 175/73 |
| 5,230,387 | | 7/1993 | Waters et al. | 175/45 |
| 5,253,721 | * | 10/1993 | Lee | 175/73 |
| 5,332,049 | | 7/1994 | Tew | 175/320 |
| 5,465,797 | | 11/1995 | Wentworth et al. | 173/91 |
| 5,490,569 | | 2/1996 | Brotherton et al. | 175/61 |
| 5,544,712 | | 8/1996 | McEwen et al. | 175/57 |
| 5,630,342 | | 5/1997 | Owoc | 81/57.39 |
| 5,682,956 | * | 11/1997 | Deken et al. | 175/19 |
| 5,692,576 | | 12/1997 | Hesse et al. | 175/45 |
| 5,769,505 | | 6/1998 | Siddle et al. | 299/102 |
| 5,839,524 | | 11/1998 | Sanford | 175/320 |
| 5,880,680 | | 3/1999 | Wisehart et al. | 340/853.4 |
| 5,941,322 | * | 8/1999 | Stephenson et al. | 175/62 |
| 6,148,935 | * | 11/2000 | Wentworth et al. | 175/398 |

* cited by examiner

*Primary Examiner*—Robert E Pezzuto
(74) *Attorney, Agent, or Firm*—Mckinney & Stringer, P.C.

(57) ABSTRACT

A taper-drive replaceable boring head for use in horizontal directional drilling applications that utilizes a taper-lock shank with an engaged tang to drive the replaceable boring head during drilling. The boring head assembly utilizes a non-threaded slip-fit connection composed of a tapered shank and a cooperating sleeve along with a mechanism for urging the shank deeper into the cooperating sleeve to provide frictional engagement therebetween. The shank includes a non-circular, asymmetrically shaped tang driver that provides torque transfer from the drill string to the boring head. It only permits one clocking orientation of the boring head relative to the position of the beacon located within the beacon housing. The boring head is retained in position by a longitudinal locking assembly using multiple set screws threadably received in the shank receiving recess sleeve openings. The set screws bear against a circumferential groove on the surface of the tapered shank. The sleeve openings are angled in such a manner that as the screws are threaded into the openings, the shank is urged deeper into the recess. A seal is interposed to prevent leakage of the drilling fluid. The tapped holes for the set screws alternatively, may be aligned with a series of spot faces on the face of the taper to ensure that the head could only be used in one orientation.

39 Claims, 5 Drawing Sheets

REMOVABLE BORING HEAD WITH TAPERED SHANK CONNECTOR

FIELD OF THE INVENTION

The present invention relates generally to boring head assemblies for horizontal drilling machines, and more particularly to boring head assemblies with removable boring heads.

BACKGROUND OF THE INVENTION

Horizontal drilling machines are utilized to drill underground bore holes for utility lines and other underground pipes. Using this type of trenchless drilling minimizes disruption of surface soil. This decreases the cost of laying utility lines especially in developed areas, and also substantially decreases the possibility of damaging previously buried utility lines and other underground structures.

In most cases the drilling machine comprises a frame, a motorized drive system mounted on the frame, and a drill string connected on one end to the drive system and on the other end to a boring tool/boring head assembly. The motorized drive system provides thrust to advance the drill string through the ground according to a planned bore path.

The boring head is commonly steered using a "slant-face" drill bit or some other suitable mechanism. A radio transmitter or other tracking device such as a "beacon" encased in housing may be provided in or directly behind the boring head to permit the tracking of the boring head.

Underground boring operations involve thrusting and rotating of the boring head in rocky and abrasive soil conditions, thereby increasing the probability of damage to the component parts of the boring head. To permit removal and/or replacement of the drill bit and other components, it is desirable for the boring head to be removably attached to the end of the drill string or beacon housing. To this end many boring heads are attached by a threaded connection. However, because of high rotational impact loading exerted on such joints, it is often difficult to disengage or "break out" these threaded joints.

In addition it is difficult to utilize a threaded joint to connect a replaceable head. This is especially true when utilizing a beacon housing where the transmitter is inserted from the side for easy maintenance of the electronics and where the orientation of the head should match the "clocking" of the beacon.

Therefore, while conventional removable boring heads have provided advantages in repair and maintenance of boring head assemblies, there remains a need for a more easily detachable boring head that is used in conjunction with a radio transmitter. The present invention is directed to an improvement to boring head assemblies with removable boring heads that specifically address this problem.

SUMMARY OF THE INVENTION

The present invention comprises a boring head assembly for attachment to the end of a drill string on a horizontal drilling machine. The boring head assembly comprises a connecting member having a front end and a rear end, a boring head having a front end and a rear end, a tapered shank, a sleeve defining a shank receiving recess, means for locking the tapered shank longitudinally in the shank receiving recess and means for providing a positive torque transfer from the connecting member to the boring head.

The rear end of the connecting member is connectable to the end of the drill string, while the tapered shank extends from the front end of the connecting member or the rear end of the boring head. The sleeve defining the shank receiving recess may either extend from the front end of the connecting member or the rear end of the boring head. The shank receiving recess is shaped to conform to the tapered shank. The torque transfer means is adapted to transfer torque at least in part by urging the shank deeper into the shank receiving recess to provide frictional engagement therebetween.

Another preferred embodiment of the present invention comprises a boring head assembly for attachment to the end of a drill string on a horizontal drilling machine, the boring head assembly comprising a connecting member having a front end and a rear end, a boring head having a front end and a rear end, a tapered shank, a sleeve defining a shank receiving recess, a longitudinal locking assembly, and a torque transfer assembly.

The rear end of the connecting member is connectable to the end of the drill string; while the tapered shank extends from the front end of the connecting member or the rear end of the boring head. The sleeve defining the shank receiving recess may either extend from the front end of the connecting member or the rear end of the boring head. The shank receiving recess is shaped to conform to the tapered shank. In the present embodiment the torque transfer assembly is adapted to transfer torque from the connecting member to the boring head at least in part by urging the shank deeper into the recess to provide frictional engagement therebetween. Finally, the longitudinal locking assembly is adapted to lock the tapered shank longitudinally in the shank receiving recess.

Yet another preferred embodiment of the present invention comprises a horizontal drilling machine for attachment to the end of a drill string, the boring head assembly comprising, a connecting member having a front end and a rear end, a boring head having a front end and a rear end, a tapered shank, a sleeve defining a shank receiving recess, a longitudinal locking assembly, and a torque transfer assembly.

The rear end of the connecting member is connectable to the end of the drill string; while the tapered shank extends from the front end of the connecting member or the rear end of the boring head. The sleeve defining the shank receiving recess may either extend from the front end of the connecting member or the rear end of the boring head. The shank receiving recess is shaped to conform to the tapered shank. In the present embodiment the torque transfer assembly is adapted to transfer torque from the connecting member to the boring head at least in part by urging the shank deeper into the recess to provide frictional engagement therebetween. Finally, the longitudinal locking assembly is adapted to lock the tapered shank longitudinally in the shank receiving recess.

BRIEF DESCRIPTION OF THE DRAWINGS

FIG. 6 shows a partially sectional, exploded view of another embodiment of the boring head assembly comprising a draw bolt.

DETAILED DESCRIPTION

The present invention provides a boring head that is removably connected to the end of the drill string by means of a non-threaded, slip-fit connection. The connection comprises a tapered shank and cooperating sleeve along with a means for urging the shank deeper into the cooperating sleeve to provide frictional engagement therebetween. Preferably, the shank includes an asymmetrically shaped tang driver to ensure positive torque transfer from the drill string to the boring head, yet avoid the difficulties associated with threaded joints. The asymmetric tang has the added advantage of permitting only one clocking orientation of the boring head relative to the position of the beacon located within the beacon housing.

Figure 1:
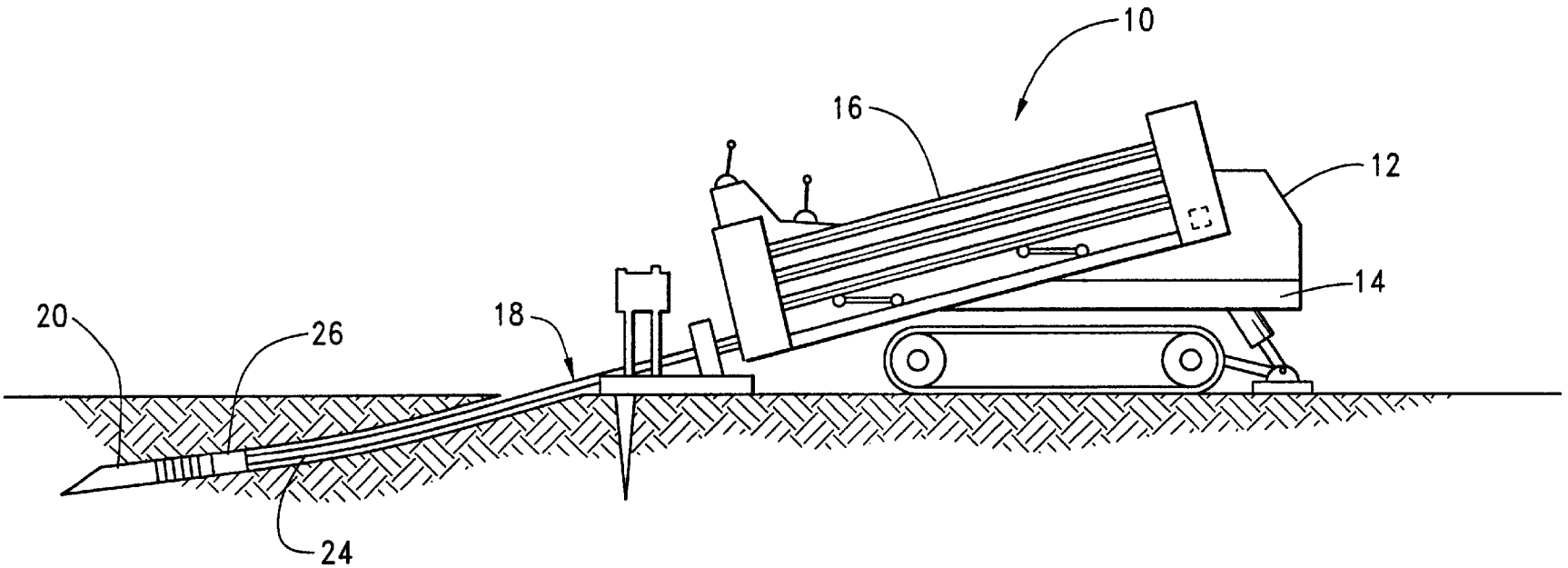
FIG. 1 shows a side elevational view of a horizontal boring machine constructed in accordance with the present invention.

The present invention also includes a longitudinal locking mechanism for securing the tapered shank in the sleeve between the beacon housing and the boring head. This locking mechanism preferably utilizes a plurality of set screws or in the alternative a draw bolt. The screws or alternatively the draw bolt enable the boring head to be easily removed or replaced without breaking loose a high torque threaded joint Turning now to the drawings in general and to FIG. 1 in particular, there is shown therein a horizontal drilling machine constructed in accordance with the present invention and designated generally by the reference numeral 10. The drilling machine 10 comprises a frame 14 that supports a drive system 12. The drive system 12 receives joints of pipe from a pipe handling system 16 to form the drill string 18. The drive system 12 axially advances and retracts the drill string 18. A boring head assembly 20 is supported on the end of the drill string 18. In the embodiment shown, the drive system 12 of the boring machine 10 utilizes hydraulic jacking or thrust; but other drive mechanisms as pneumatic and percussive can be substituted.

The machine 10 illustrated is only an example of one of many types of boring and drilling machines available. The present invention is not limited to any particular type or model of machine.

In most applications, electronics are provided for tracking the boring head. To that end affixed to a downhole end 24 of the drill string 18 is housing for electrical apparatus generally referred to as the beacon housing 26. The beacon housing 26 holds a radio transmitter or other tracking device "beacon". The transmitter is usually positioned immediately behind the boring head 20.

Figure 2:
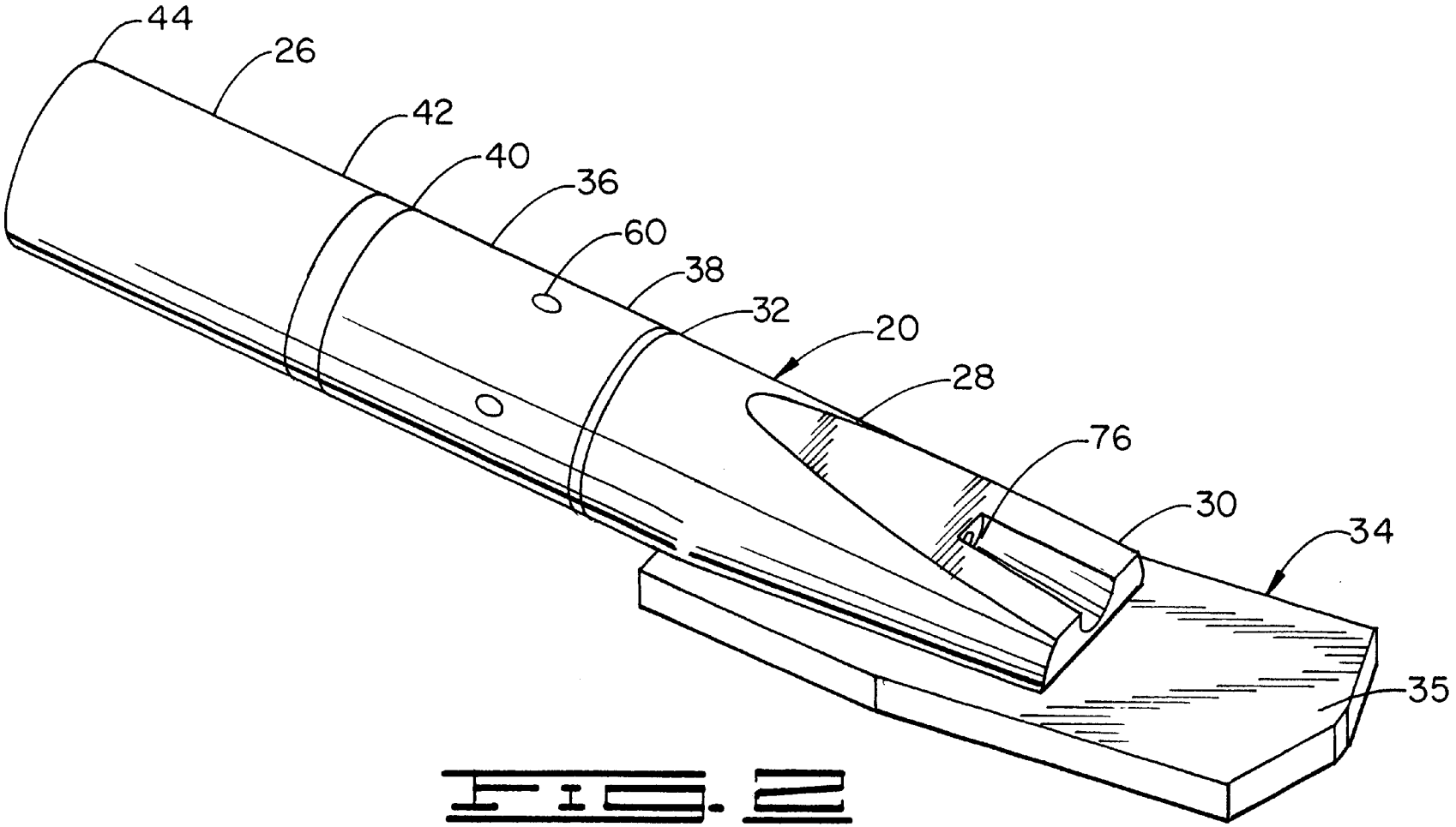
FIG. 2 shows a perspective view of a boring head assembly.
Figure 3:
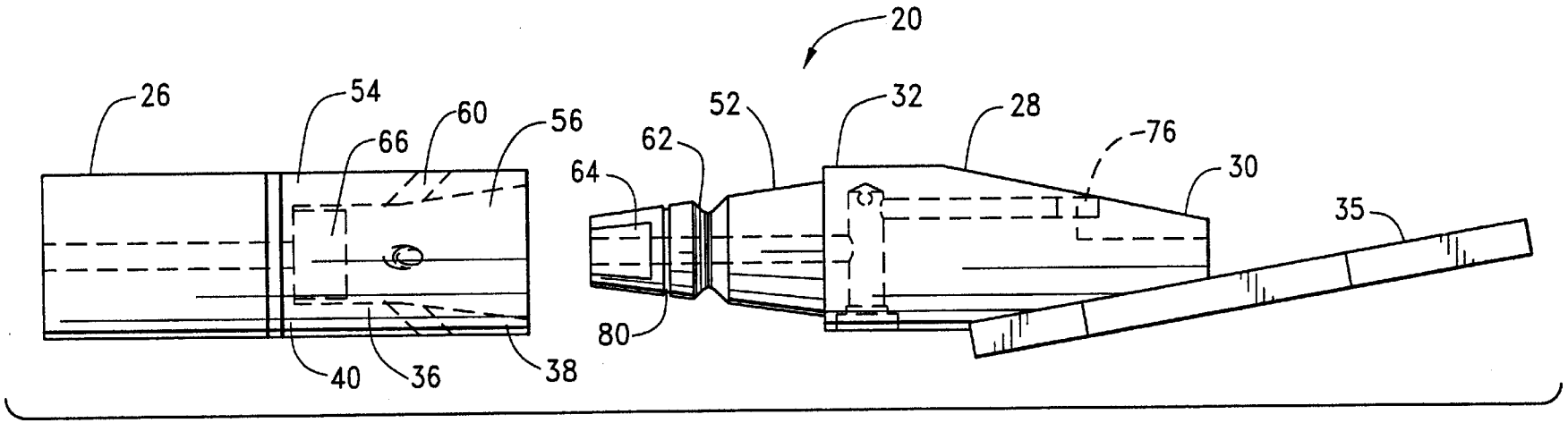
FIG. 3 is a side elevational, exploded view of the boring head assembly of FIG. 2.
Figure 4:
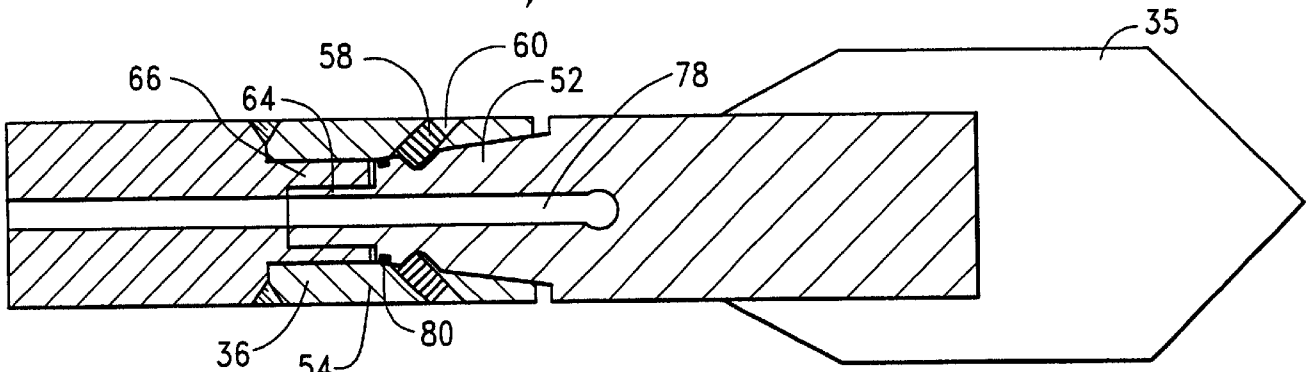
FIG. 4 is a longitudinal sectional top view of the boring head assembly of FIG. 2.

Turning now to FIGS. 2, 3 and 4, the preferred boring head assembly 20 will be described. The boring head assembly 20 comprises a boring head 28. The boring head 28 has a front end 30 and a rear end 32. A cutting element such as a blade assembly 34 can be mounted on the front end of the boring head assembly 20.

The blade assembly 34 commonly comprises a drill bit 35 angled with respect to the beacon housing to provide a slant face. Use of a drill bit of some sort that is either permanently or removably attached to the boring head 28 is desirable. However, a removable slant face drill bit 35 is preferred for most soils. Other types of bits that can be substituted include, roller cone bits, and single or multi blade boring heads. The bit 35 is attached by a bolt (not shown) to the boring head 28. However, other forms of attachment can be used. Alternatively, the head itself may be fitted with carbide teeth and wear buttons for cutting holes without a separable cutting member.

The blade assembly 34 may also have serrated ends or teeth or any other sort of cutting edge. However, the decision on which type of cutting element to use depends upon various factors. Some examples include the type of the soil at the construction site, depth and horizontal distance of drilling, type and size of the material being installed, and other factors.

Generally, the rear end of the boring head 28 is connected to the front end of the drill string 18. More specifically, where a beacon housing 26 is included, then the boring head 28 is attached to the beacon housing through a connecting member 36. The connecting member 36 has a front end 38 and a rear end 40. The rear end 40 of the connecting member 36 is attached to the front end 42 of the beacon housing 26 (or the front end of the drill string in the event there is no beacon housing). This attachment may be removable, semi-permanent or permanent. However, in most instances it is desirable to permanently affix the connecting member 36 to the beacon housing 26. Welding has proven an effective means of permanently attaching the connecting member 36 to the beacon housing 26 (or the drill string 18). Alternatively, the connecting member may be formed as an integral part of the beacon housing.

The front end 38 of the connecting member 36 is removably connectable to the rear end 32 of the boring head 28. This connection provides torque transfer from the connecting member 36 to the boring head 28 utilizing a non-threaded slip-fit connection.

Moving to FIGS. 3–4, the boring head assembly 20 comprises a tapered shank 52. The tapered shank 52 tapers from a larger diameter at its base to a smaller diameter at its front end. However, the length and diameter of the taper on the tapered shank will depend on several factors. Some of these factors include but are not limited to size of the boring head 20, rotational torque of the drilling machine, drilling capabilities of the drilling machine, soil conditions at the drilling site, and type of retention means used for urging the mating taper surfaces together.

It is preferably conical in shape and as conceived utilizes a standard 3.5/12 steep machine taper. This taper could be steeper or shallower. However, typically the body taper length can range from 2 inches to 6 inches and the diameter of the taper can range from 2.5 inches to 5 inches.

The body of the tapered shank 52 is preferably formed of a sturdy, high tensile strength material, and preferably a steel alloy. Although various materials may be used to build the body, a high strength, alloy steel generally provides the necessary strength and durability to resist wear and abrasion. Use of this material contributes to increasing the life of the tapered shank 52.

For receiving the tapered shank 52, the boring head assembly 20 further comprises a sleeve 54 formed in the connecting member 36. The sleeve 54 in turn defines a shank receiving recess 56 shaped to conform to the tapered shank 52 as illustrated in FIGS. 3 and 4.

As shown in FIGS. 2–4, the tapered shank 52 extends from the rear end 32 of the boring head 28 and the sleeve extends from the front end 38 of the connecting member 36 to receive the tapered shank 52. It will be appreciated however, that this configuration can be reversed and yet provide the desired result. For example, the sleeve 54 can extend from the rear end 32 of the boring head 28 and the tapered shank 52 can extend from the front end 38 of the connecting member 36.

The boring head assembly 20 preferably is provided with an assembly for locking the tapered shank 52 longitudinally in the shank receiving recess 56. In the preferred embodiments as demonstrated in FIGS. 2–4, the longitudinal locking assembly comprises set screws 58 threadably receivable in a plurality of angled openings 60. These openings 60 extend through a side wall of the sleeve 54 and are aligned with a circumferential groove 62 in the tapered shank 52. When the tapered shank 52 is received in the recess 56 and the set screws 58 are received in the openings, 60 the ends of the screws extend into the groove. In this manner a secure connection is achieved utilizing the longitudinal locking assembly.

In addition, the angle of the openings 60 preferably is acute relative to the axis X—X of the boring head 28 and the beacon housing 26 (as seen in FIG. 4). The acute angle of the openings 60 acts to urge the tapered shank 52 deeper into the recess 56 when the screws are tightly threaded into the openings. The result is a tight frictional engagement between the entire surface area of the tapered shank 52 and the recess 56.

The preferred embodiment of the boring head includes a torque transfer assembly for providing a positive torque transfer from the connecting member 36 to the boring head 28. The positive torque transfer assembly comprises a non-circular tang driver 64 extending from the end of the tapered shank 52. The tang driver 64 ensures that the tapered shank 52 will not slip relative to the tapered shank receiving recess 56 under load, thereby forming a positive torque transfer mechanism.

While one preferred configuration is shown, other non-cylindrical configurations of the tang driver will also allow a positive torque transfer. Some examples of these configurations include hexagonal, splined, elliptical, octagonal, star-shaped, and half-moon. More preferably, the tang driver is asymmetrical for a reason which will become apparent.

The tang driver 64 in turn is received in a tang receiving recess 66 shaped to conform to the tang driver. The tang receiving recess 66 is formed in the sleeve 54 and preferably, is continuous with the shank receiving recess 56.

As stated earlier, the tapered shank 52 along with the tang driver 64 extends from the rear end 32 of the boring head 28 and the sleeve 54 extends from the front end 38 of the connecting member 36. However, this configuration may be reversed, as illustrated in another embodiment described hereafter.

Figures 4, 5:
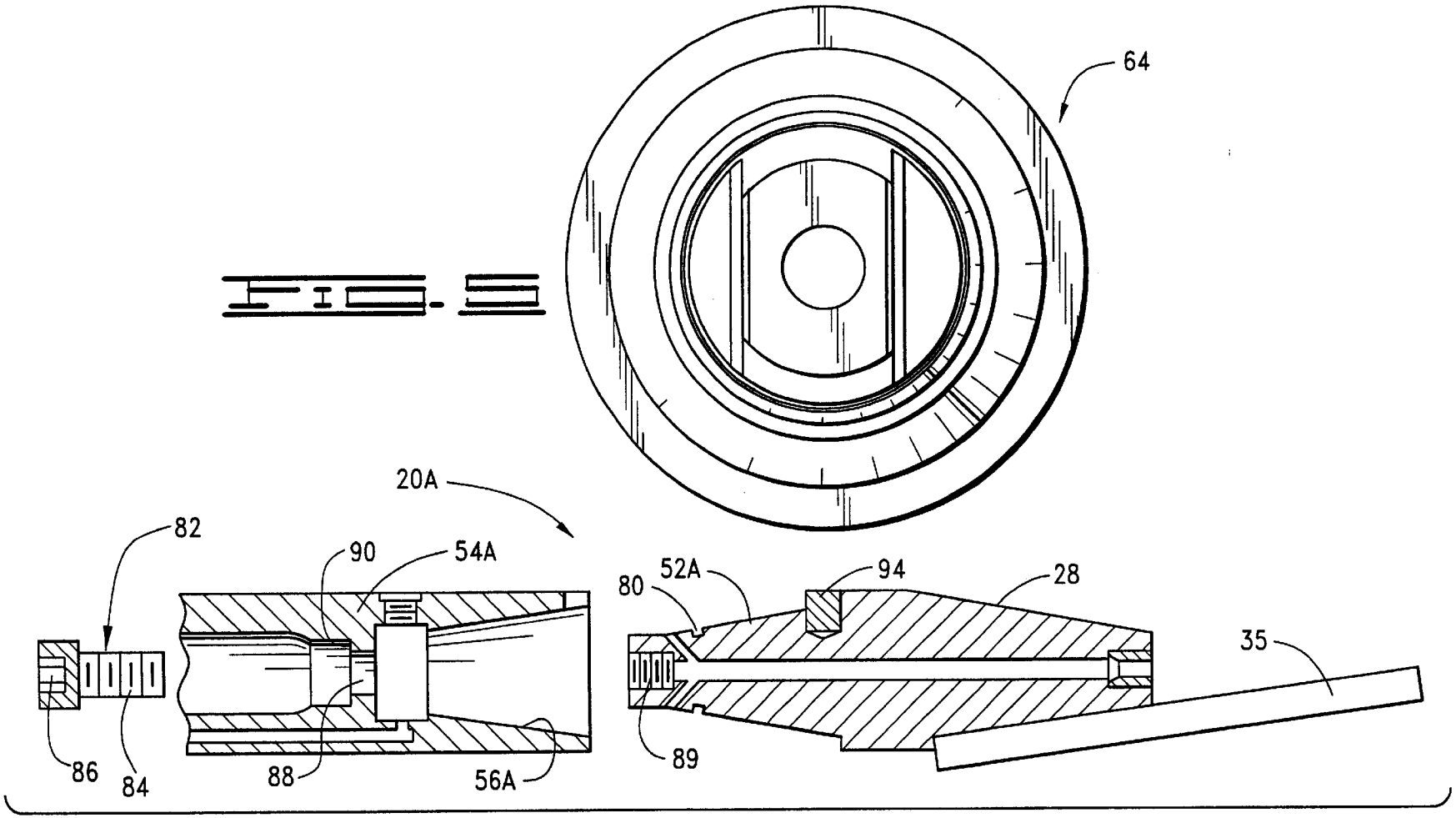
FIG. 5 is an end elevational view of the asymmetric tang of the boring head assembly of FIG. 2.

An advantage of the connection between the tang driver 64 and the tang driver receiving recess 66 lies in the asymmetry of the tang driver as seen in FIG. 5. This asymmetry permits the slip-fit connection to ensure one clocking orientation of the tang driver 64 with respect to the boring head 28. The clocking orientation of the tang driver 64 is important with use of "side load" housings that do not permit rotation of the beacon in the beacon housing. It is also important to accurately steer the drill bit when using an offset drill bit at the end of the drill string. This permits the operator to know the direction in which the drill bit is pointed before further advancing the drill string. The boring head assembly 20 of this invention includes a means to provide a clockface orientation of the drill bit 35.

In the preferred embodiment this feature can be integrated into the torque transfer assembly by selecting a tang driver 64 that is shorter on one side than the other. That is, the tang driver can be machined in an asymmetrical manner. This permits the tang driver 64 to fit into the tang receiving recess 66 in only one clocking orientation. This thus ensures that the boring head 28 can have only one clocking orientation with respect to the beacon located in the beacon housing.

It is apparent that other alternatives may be used to provide one clocking orientation of the boring head 28 relative to the beacon in the beacon housing 26. An example of an alternative mechanism includes aligning the tapped openings 60 for the setscrews 58 with a series of spot faces on the face of the tapered shank 52 in lieu of a circular groove. Other examples include using a pin or other protrusion at the external interface between the boring head 28 and the beacon housing 26 instead of the offset tang. Another alternative would be a keyway in the shank receiving recess 56 at the same angle as the taper and a mating key in the tapered shank 52.

Thus it will be appreciated that in the preferred embodiment, the asymmetry of the tang driver 64 contributes to the torque transfer and the clocking orientation of the boring head. The positioning of the screws assists in urging the tapered shank 52 deeper into the shank receiving recess 56 to provide frictional engagement therebetween. In this manner a means for longitudinally locking the tapered shank 52 and urging the shank deeper into the recess 56 to provide frictional engagement therebetween is provided.

In most boring operations drilling fluid is utilized to cool the boring head 28 and to lubricate and soften the spoils. This fluid is usually pumped and delivered to the end of the boring head 28 by means of some conduit through the drill string 18. The boring head assembly 20 of this invention is easily adapted to provide fluid flow in a conventional manner. As illustrated in FIG. 2, fluid exits the boring head through the fluid nozzle 76. The fluid passes through boring head 28 through a fluid conduit 78 as shown in FIG. 4. The pumped water is ported around the cavity housing the electronic components, thereby cooling it.

To contain the fluid flow, a fluid tight seal is desirable between the tapered shank 52 and the shank receiving recess 56. This prevents fluid leakage as the fluid passes through the drill string 18 to the boring head 28. In the present invention this fluid tight seal is accomplished by employing a conventional O-ring received in a second circumferential groove 80 in the lower broader tapered portion of the tapered shank as shown in FIG. 3.

When the flow of the drilling fluid stops (for example when adding another pipe to the drill string 18), back flow of the fluid may occur. For this purpose, either the boring head assembly 20 or the beacon housing 26 may be fitted with a conventional check valve assembly in the fluid passage. The check valve assembly acts to prevent back flow of fluid into the nozzle 76 whenever the flow of drilling fluid is stopped.

Figure 7:
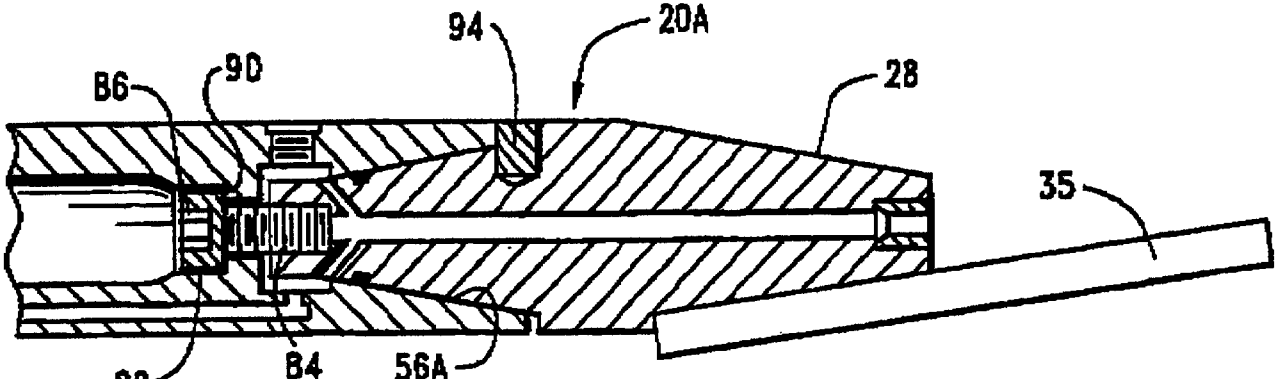
FIG. 7 is a partially sectional, side elevational view of the boring head assembly of FIG. 6.

Shown in FIGS. 6 and 7 is yet another embodiment of the present invention designated by the reference number 20A. In this embodiment the longitudinal locking assembly and the shank urging torque transfer assembly comprise a draw bolt 82 instead of set screws. The draw bolt 82 comprises a threaded stem 84 and a head 86 that is wider than the stem. The threaded stem 84 of the draw bolt 82 passes through an aperture 88 in the sleeve 54A. This aperture 88 is defined at the inner end of the shank receiving recess 56A. The threaded stem 84 is then in turn threadably received by a threaded bore 89 present on the end of the tapered shank 52A. The head 86 of the draw bolt 82 abuts a shoulder 90 formed adjacent to the aperture 88 in the shank receiving recess 56A.

Fastening the draw bolt 82 pulls the shank 52A into engagement with the conical recess 56A. Therefore, the draw bolt urges the tapered shank 52A deeper into the shank receiving recess 56A, by a pulling action and thereby provides frictional engagement therebetween.

Figure 8:
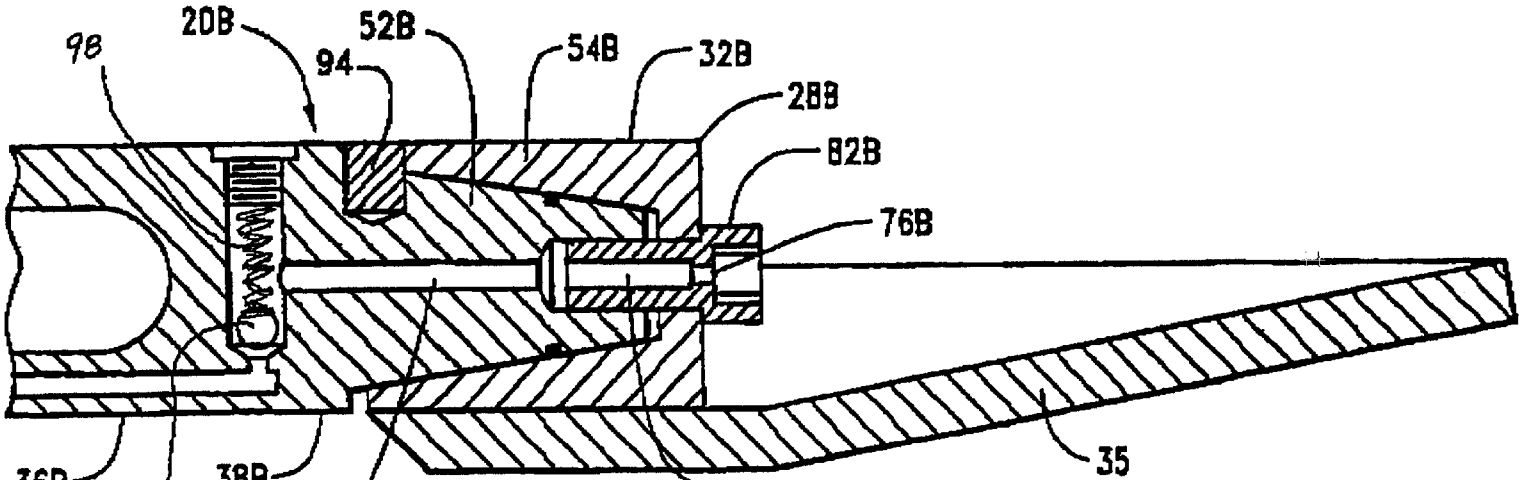
FIG. 8 is a longitudinal sectional view of a third embodiment of the boring head assembly using a draw bolt in reverse configuration to FIG. 6. (In this embodiment the threaded portion of the draw bolt extends from the rear end of the boring head assembly. It is threadably received by the sleeve extending from the tapered shank at the front end of the connecting member.)

FIG. 8 shows yet another embodiment of the boring head assembly 20B. In this embodiment the arrangement of the tapered shank 52B and the sleeve 54B is reversed. As illustrated, the tapered shank 52B extends from the front end 38B of the connecting member 36B and the sleeve 54B is formed at the rear end 32B of the boring head 28B. So, too, can the position of the draw bolt 82B be reversed. However, as in the previous embodiments a fluid channel is desirable to allow passage of the drilling fluid through the drill string 18 to the boring head assembly 20. A steel ball 96 and a compression spring 98 act as a check valve assembly to prevent back flow of drilling fluid into the nozzle 76B when the flow is stopped at the drilling machine 10. However, other configurations of the check valve assembly will also prevent back flow of drilling fluid. In this embodiment, the draw bolt 82B forms part of the fluid channel 78B.

The body of the draw bolt 82 is hollow and includes a through channel 92 to permit passage of the fluid through the draw bolt 82B. The through channel 92 is continuous with the fluid channel 78B. As a result the fluid flows through the draw bolt 82B from the connecting member 36B to the boring head 28B. The end of the boring head 28B is then similarly adapted to provide an exit for the fluid in the conventional manner. As illustrated in FIG. 2, fluid exits the boring head through the fluid nozzle 76B, which is continuous with the fluid channel 78B. As in the previous embodiment, a fluid seal like the conventional O-ring may be included. Alternately, the fluid may be ported around the draw bolt before exiting through the nozzle.

It may be noted that use of the orienting pin 94 to determine the clocking orientation of the boring head relative to the housing, is preferred, in the embodiments utilizing the draw bolt 82B. In addition the boring head 28B may be designed such that the bit 35 is bolted onto the boring head 28B. However, in the present embodiment, the boring head 28B is manufactured such that the replaceable head and the boring bit 35 are formed as one integral piece e.g. casting.

While the above description constitutes preferred embodiments of the present invention, it will be appreciated that the invention is susceptible to modification, variation and change without departing from the proper scope and fair meaning of the accompanying claims.

What is claimed is:

1. A boring head assembly for attachment to the end of a drill string on a horizontal drilling machine, the boring head assembly comprising:

a connecting member having a front end and a rear end, the rear end connectable to the end of the drill string;

a boring head having a front end and a rear end;

a tapered shank extending from the rear end of the boring head or the front end of the connecting member;

a sleeve defining a shank receiving recess, the sleeve extending from the front end of the connecting member or the rear end of the boring head, the recess being shaped to conform to the tapered shank;

means for locking the tapered shank longitudinally in the shank receiving recess; and means for providing torque transfer from the connecting member to the boring head at least in part by urging the shank deeper into the recess to provide frictional engagement therebetween.

2. The boring head assembly of claim 1 comprising a beacon housing.

3. The boring head assembly of claim 1 wherein the torque transfer means further comprises a non-threaded, slip-fit connection between the shank and the sleeve.

4. The boring head assembly of claim 3 wherein the non-threaded, slip-fit connection comprises:

a tang driver extending from the end of the shank, the tang driver being non-circular in cross-section; and a tang driver receiving recess in the sleeve shaped to conform to the tang driver.

5. The boring head assembly of claim 1 further comprising means for permitting only one clocking orientation of the boring head.

6. The boring head assembly of claim 5 wherein the clocking means comprises an asymmetrical tang driver.

7. The boring head assembly of claim 1 wherein the sleeve comprises a side wall and wherein the longitudinal locking means comprises:

a circumferential groove in the tapered shank;

a plurality of set screws; and a plurality of openings to threadably receive the set screws, the openings extending through the side wall of the sleeve and aligned with groove so that when the shank is received in the recess and set screws are received in the openings, the ends of the screws extend into the groove.

8. The boring head assembly of claim 1 wherein the means for longitudinally locking the tapered shank and the shank urging torque transfer means comprises:

a circumferential groove in the tapered shank;

a plurality of set screws;

a plurality of openings to threadably receive the set screws, the openings extending through the side wall of the sleeve and aligned with groove so that when the shank is received in the recess and set screws are received in the openings, the ends of the screws extend into the groove; and wherein the openings are angled so that as the screws are threaded into the openings, the screws urge the shank deeper into the recess.

9. The boring head assembly of claim 1 further comprising a fluid passageway through the connecting member and the boring head.

10. The boring head assembly of claim 9 comprising a seal interposed between the connecting member and the boring head.

11. The boring head assembly of claim 1 wherein the longitudinal locking means comprises:

a draw bolt having a threaded stem and a head wider than the stem;

a threaded bore on the end of the shank to receive the threaded stem; and wherein the sleeve defines an aperture at the inner end of the shank receiving recess and a shoulder formed adjacent to the aperture to receive the head of the draw bolt.

12. The boring head of claim 1 wherein the tapered shank extends from the rear end of the boring head and the sleeve is formed in the front end of the connecting member.

13. The boring head of claim 1 wherein the tapered shank extends from front end of the connecting member and the sleeve is formed at the rear end of the boring head.

14. A boring head assembly for attachment to the end of a drill string on a horizontal drilling machine, the boring head assembly comprising:

a connecting member having a front end and a rear end, the rear end connectable to the end of the drill string;

a boring head having a front end and a rear end;

a tapered shank extending from the rear end of the boring head or the front end of the connecting member;

a sleeve defining a shank receiving recess, the sleeve extending from the front end of the connecting member or the rear end of the boring head, the recess being shaped to conform to the tapered shank;

a longitudinal locking assembly adapted to lock the tapered shank longitudinally in the shank receiving recess; and a torque transfer assembly adapted to transfer torque from the connecting member to the boring head at least in part by urging the shank deeper into the recess to provide frictional engagement therebetween.

15. The boring head assembly of claim 14 comprising a beacon housing.

16. The boring head assembly of claim 14 wherein the torque transfer assembly further comprises a non-threaded, slip-fit connection between the shank and the sleeve.

17. The boring head assembly of claim 16 wherein the non-threaded, slip-fit connection comprises:

a tang driver extending from the end of the shank, the tang driver being non-circular in cross-section; and a tang driver receiving recess in the sleeve shaped to conform to the tang driver.

18. The boring head assembly of claim 14 further comprising means for permitting only one clocking orientation of the boring head.

19. The boring head assembly of claim 18 wherein the clocking means comprises an asymmetrical tang driver.

20. The boring head assembly of claim 14 wherein the sleeve comprises a side wall and wherein the longitudinal locking assembly comprises:

a circumferential groove in the tapered shank;

a plurality of set screws; and a plurality of openings to threadably receive the set screws, the openings extending through the sidewall of the sleeve and aligned with groove so that when the shank is received in the recess and set screws are received in the openings, the ends of the screws extend into the groove.

21. The boring head assembly of claim 14 wherein the longitudinal locking assembly and the shank urging torque transfer assembly comprise:

a circumferential groove in the tapered shank;

a plurality of set screws;

a plurality of openings to threadably receive the set screws, the openings extending through the sidewall of the sleeve and aligned with groove so that when the shank is received in the recess and set screws are received in the openings, the ends of the screws extend into the groove; and wherein the longitudinal locking assembly openings are angled so that as the screws are threaded into the openings, the screws urge the shank deeper into the recess.

22. The boring head assembly of claim 14 further comprising a fluid passageway through the connecting member and the boring head.

23. The boring head assembly of claim 22 comprising a seal interposed between the connecting member and the boring head.

24. The boring head assembly of claim 14 wherein the longitudinal locking assembly comprises:

a draw bolt having a threaded stem and a head wider than the stem;

a threaded bore on the end of the shank to receive the threaded stem; and wherein the sleeve defines an aperture at the inner end of the shank receiving recess and a shoulder formed adjacent to the aperture to receive the head of the drawbolt.

25. The boring head of claim 14 wherein the tapered shank extends from the rear end of the boring head and the sleeve is formed in the front end of the connecting member.

26. The boring head of claim 14 wherein the tapered shank extends from front end of the connecting member and the sleeve is formed at the rear end of the boring head.

27. A horizontal drilling machine comprising a boring head assembly for attachment to the end of a drill string, the boring head assembly comprising:

a connecting member having a front end and a rear end, the rear end connectable to the end of the drill string;

a boring head having a front end and a rear end;

a tapered shank extending from the rear end of the boring head or the front end of the connecting member;

a sleeve defining a shank receiving recess, the sleeve extending from the front end of the connecting member or the rear end of the boring head, the recess being shaped to conform to the tapered shank;

a longitudinal locking assembly adapted to lock the tapered shank longitudinally in the shank receiving recess; and a torque transfer assembly adapted to transfer torque from the connecting member to the boring head at least in part by urging the shank deeper into the recess to provide frictional engagement therebetween.

28. The drilling machine boring head assembly of claim 27 comprising a beacon housing.

29. The drilling machine boring head assembly of claim 27 wherein the torque transfer assembly further comprises a non-threaded, slip-fit connection between the shank and the sleeve.

30. The drilling machine boring head assembly of claim 29 wherein the non-threaded slip-fit connection comprises:

a tang driver extending from the end of the shank, the tang driver being non-circular in cross-section; and a tang driver receiving recess in the sleeve shaped to conform to the tang driver.

31. The drilling machine boring head assembly of claim 27 further comprising means for permitting only one clocking orientation of the boring head.

32. The drilling machine boring head assembly of claim 31 wherein the clocking means comprises an asymmetrical tang driver.

33. The drilling machine boring head assembly of claim 27 wherein the sleeve comprises a sidewall and wherein the longitudinal locking assembly comprises:

a circumferential groove in the tapered shank;

a plurality of set screws; and a plurality of openings to threadably receive the set screws, the openings extending through the sidewall of the sleeve and aligned with groove so that when the shank is received in the recess and set screws are received in the openings, the ends of the screws extend into the groove.

34. The drilling machine boring head assembly of claim 27 wherein the longitudinal locking assembly and the shank urging torque transfer assembly comprise:

a circumferential groove in the tapered shank;

a plurality of set screws;

a plurality of openings to threadably receive the set screws, the openings extending through the sidewall of the sleeve and aligned with groove so that when the shank is received in the recess and set screws are received in the openings, the ends of the screws extend into the groove; and wherein the openings are angled so that as the screws are threaded into the openings, the screws urge the shank deeper into the recess.

35. The drilling machine boring head assembly of claim 27 further comprising a fluid passageway through the connecting member and the boring head.

36. The drilling machine boring head assembly of claim 35 comprising a seal interposed between the connecting member and the boring head.

37. The drilling machine boring head assembly of claim 27 wherein the longitudinal locking assembly comprises:

a draw bolt having a threaded stem and a head wider than the stem;

a threaded bore on the end of the shank to receive the threaded stem; and wherein the sleeve defines an aperture at the inner end of the shank receiving recess and a shoulder formed adjacent to the aperture to receive the head of the drawbolt.

38. The drilling machine boring head of claim 27 wherein the tapered shank extends from the rear end of the boring head and the sleeve is formed in the front end of the connecting member.

39. The drilling machine boring head of claim 27 wherein the tapered shank extends from front end of the connecting member and the sleeve is formed at the rear end of the boring head.

* * * * *

UNITED STATES PATENT AND TRADEMARK OFFICE

CERTIFICATE OF CORRECTION

PATENT NO. : 6,311,790 B1 
DATED : November 6, 2001
INVENTOR(S) : Jerry W. Beckwith and Floyd R. Gunsaulis It is certified that error appears in the above-identified patent and that said Letters Patent is hereby corrected as shown below:

Title page,
Item [73], under the Assignee, delete "Machines" and substitute therefor -- Machine --.

Signed and Sealed this

Sixth Day of August, 2002

*Attest:*

JAMES E. ROGAN
*Director of the United States Patent and Trademark Office*

*Attesting Officer*